US005678920A

United States Patent [19]

Kerr

[11] Patent Number: 5,678,920

[45] Date of Patent: Oct. 21, 1997

[54] ILLUMINATING BRICK

[76] Inventor: Glenn Harvey Kerr, 185 Andrews Ave., Smiths Falls, Ontario, Canada, K7A 4R9

[21] Appl. No.: 416,368

[22] Filed: Apr. 4, 1995

[30] Foreign Application Priority Data

Apr. 5, 1994 [CA] Canada ..... 2120553

[51] Int. Cl.[6] ..... E01F 9/04

[52] U.S. Cl. ..... 362/145; 362/153; 362/153.1

[58] Field of Search ..... 362/145, 152, 362/153, 153.1, 362, 370, 432, 374; 40/564, 565; 52/28

[56] References Cited

U.S. PATENT DOCUMENTS

| | | | |
|---|---|---|---|
| 4,223,377 | 9/1980 | Williams | 362/145 |
| 4,570,207 | 2/1986 | Takahashi et al. | 362/152 |
| 4,697,950 | 10/1987 | Copeland | 404/9 |
| 4,744,014 | 5/1988 | Harris | 362/145 |
| 4,969,282 | 11/1990 | Eberhart | 362/362 |
| 4,992,914 | 2/1991 | Heiss et al. | 362/153.1 |
| 5,006,967 | 4/1991 | Diamond | 362/153 |
| 5,160,202 | 11/1992 | Legare | 362/153.1 |

FOREIGN PATENT DOCUMENTS 9100473 1/1991 WIPO .

*Primary Examiner*—Y My Quach
*Attorney, Agent, or Firm*—James Creighton Wray

[57] ABSTRACT

A brick device which has a hollow simulated brick portion with a light-emitting upper surface portion, and an electric bulb unit supported within the simulated brick portion whereby, in use, light is transmitted through said upper surface. The upper surface portion may be a sheet of transparent material supported on ledges and snugly-fitting within the brick portion. The base of the brick portion is open over a substantial part of its area to facilitate drainage and substantially reduce condensation.

12 Claims, 3 Drawing Sheets

ILLUMINATING BRICK

FIELD OF THE INVENTION

This invention relates to the illumination of pathways, driveways, walkways and patios. Interlocking pathways are designed around houses and other buildings and can be very attractive in appearance.

PRIOR ART

Illuminated bricks have previously been proposed but have suffered from the disadvantages that water collected in the interior of the brick and condensation collected on the inner surfaces. Furthermore, some prior illuminated bricks have been provided with screws to hold the top of the brick in place and these protruded above the top surface of the brick which is a disadvantage.

SUMMARY OF THE INVENTION

It is an object of the present invention to provide an improved brick device which has utility in illuminating an area and also enhances the appearance of the area.

According to the present invention there is provided a brick device comprising in combination a hollow simulated brick portion having a main body portion, a ledge within said main body portion around one open end, a light-emitting upper surface portion resting on said ledge to fit snugly and close said one end, an electric bulb unit supported within said brick portion whereby, in use, light is transmitted through said upper surface, the other end of said main body portion being open over a substantial part of its area to facilitate drainage and substantially reduce condensation.

According to another aspect there is provided a brick device comprising in combination a hollow simulated brick portion having a main body portion molded in one piece with a pair of opposing longitudinal side portions, a pair of opposing end portions, a base portion, and an open top, an integrally molded electric bulb support bracket portion on said base portion intermediate said pair of end portions, at least one aperture provided in said base portion, said base portion having at least one push-out portion in another aperture to provide a support platform for the brick portion in use and capable of being removed to provide a larger aperture space in said base portion, the total aperture space in said base portion being such that the brick portion is open over a part of the area of said base portion to facilitate drainage and substantially reduce condensation, a ledge around said open top of said brick portion, a light-emitting upper surface portion resting on said ledge to fit snugly and close said open top, at least one retaining tab on an edge of said light-emitting upper surface portion, a corresponding aperture in said main body portion above said ledge for said one retaining tab to engage in when said light-emitting upper surface portion rests on said ledge.

The upper surface portion may be a sheet of transparent material supported on said ledge within said brick portion.

DESCRIPTION OF THE DRAWING

Embodiments of the present invention will now be described, by way of example, with reference to the accompanying drawings in which:

FIG. 1 is a diagrammatic representation of a brick device according to one embodiment of the invention;

FIG. 2 is a plan view of the brick device of FIG. 1;

FIG. 3 is a diagrammatic representation showing the ledge used to support a sheet of transparent material.

DETAILED DESCRIPTION OF THE EMBODIMENTS

Figure 4:
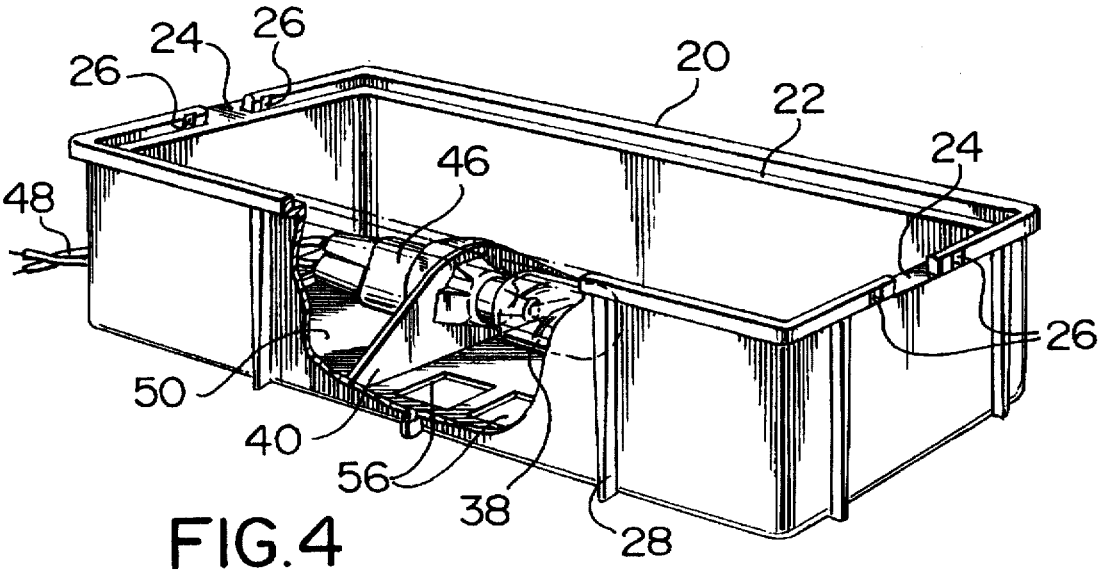
FIG. 4 is a diagrammatic perspective representation of the main body of a brick according to a further embodiment of the invention without the top lens portion.

In the Figures the brick device 2 comprises a hollow simulated brick portion 4 formed from a urethane material. A molding technique may, of course, be used and it will be seen that a ledge 6 is provided around the inside of the simulated brick portion.

A light-emitting upper surface portion 8 rests on the ledge 6 and this may be regarded as a lens unit made of lexsand and coloured with epoxy and pigment to simulate a brick, for example an interlock brick. Different colors may be used for different lighting effects. The upper surface portion fits snugly to be a tight fit and a small screwdriver or other implement is necessary to pry it upwards. Thus, it will be difficult for children or animals to disturb it and the tight fit may be achieved by close tolerances during manufacture or other means. Furthermore, it will be understood that the lens unit may provide a clear lens (upper portion) for uplighting shrubs, etc., smoked lens, or a lens to simulate an interlocking brick.

The walls of the brick portion are, for example, 3/16 of an inch thick and are a little thicker on the top with a 45 degree angle under the leg where the top lens portion will be placed. The top lens portion 8 is 3¾ inches by 7¾ inches. It will be cut from a sheet of LEXSAND™ and the color (pigment) and texture (epoxy) will be poured on top of the cut squares. The internal lower surface 10 of the brick portion will be open or partly open over a substantial part thereof whereby drainage of water can occur so as to avoid condensation.

The brick itself may be used in soldier bordering for interlock paving paths and for other purposes.

The simulated brick portion is molded with a protruding platform 12 (FIG. 1) which is drilled so as to support a bulb 14. Wires 16 extend through the portion 12 to the bulb 14 and are connected to a 12-volt power supply system 18.

In a second embodiment of the invention, the light bulb 14 may be supported from a bracket on the interior surface of the simulated brick portion.

Figure 5:
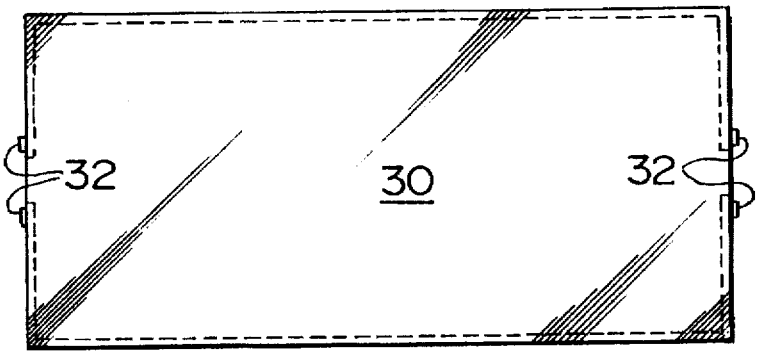
FIG. 5 is a top plan view of the top lens portion of the brick of FIG. 4.

Referring to FIGS. 4 through 9, a further embodiment of the invention is shown. The main body portion 20 of a brick is illustrated and will be seen to be molded with a pair of longitudinal side portions, a pair of opposing end portions, a base portion and an open top. The main body portion 20 is provided with a ledge 22 around the inside and a small slot 24 on each end to facilitate the use of a screwdriver, or other implement, to release the top lens portion as described below. On either side of each slot 24, an aperture 26 is provided to receive a retaining tab 32 (FIG. 5).

The external surface of the main body portion 20 is formed with slightly protruding rib members 28 for strength.

Figure 6:
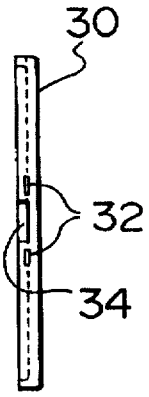
FIG. 6 is an end view of the top lens portion of FIG. 5.

In FIGS. 5 and 6 the top lens portion 30 will be seen to be rectangular in shape to fit snugly within the top of the main body 20 resting on the ledge 22. At each end of the top lens portion 30, a pair of spaced-apart retaining tabs 32 is provided and during manufacture a slot 34 is formed between the tabs and, in use, each slot 34 will be in-line with a corresponding slot 24 in the main body portion 20 (FIG. 4).

Figure 7:
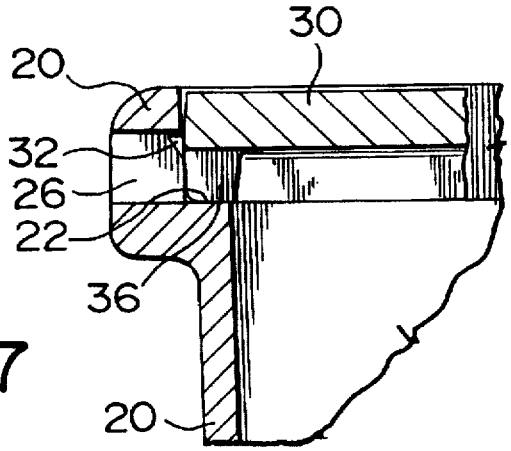
FIG. 7 is a cross-sectional side view of the end of the top lens portion of FIG. 5 resting on a ledge provided on the main body of the brick of FIG. 4.
Figure 4:
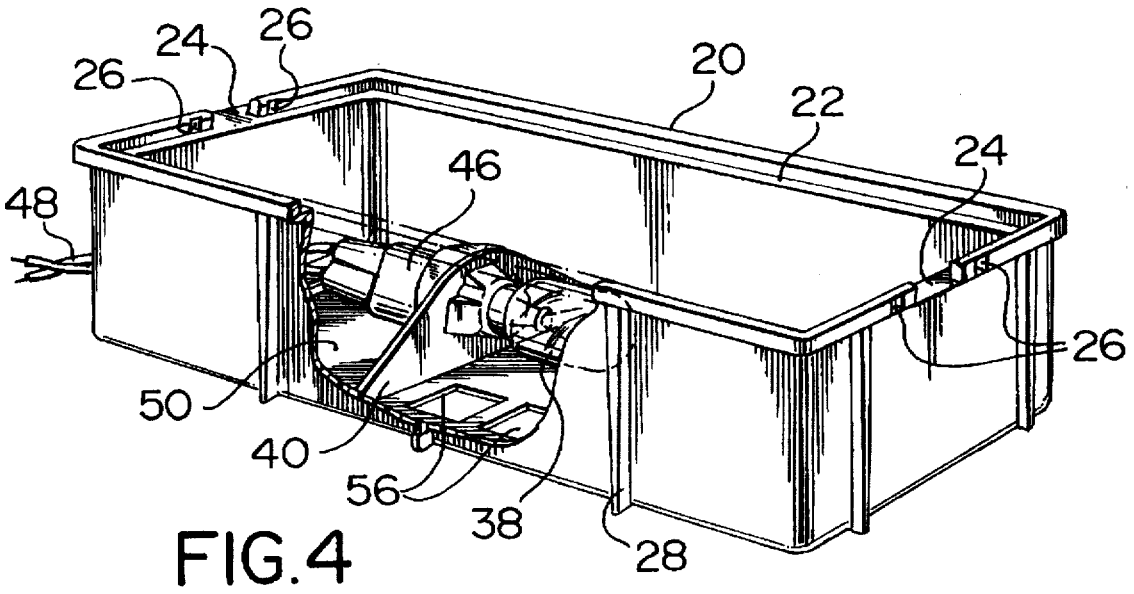
Figure 5:
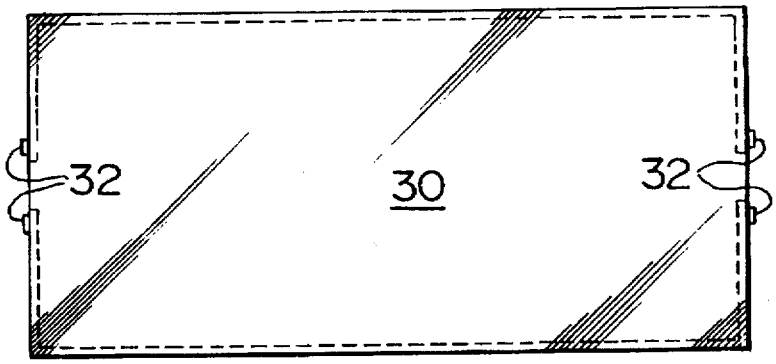
Figure 6:
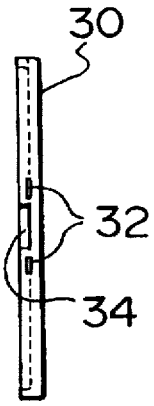
Figure 7:
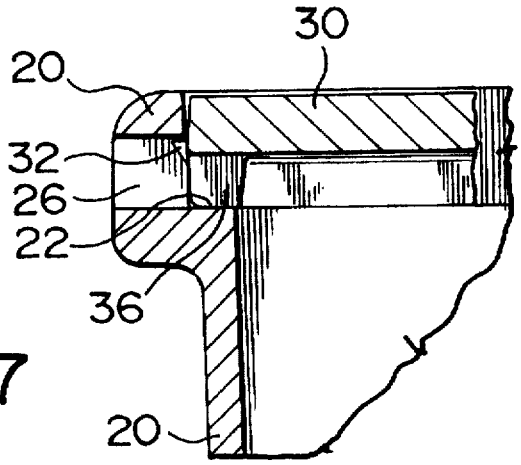

In FIG. 7 a cross-section of part of the body portion 20 is shown and the ledge 22 supports a downwardly protruding portion 36 of the top lens portion 30. The retaining tab 32 is relatively small and of triangular cross-section. Thus it can be readily snapped out of the aperture 26 by use of a suitable implement when it is wished to remove the top lens portion 30 from the main body portion 20.

Figure 8:
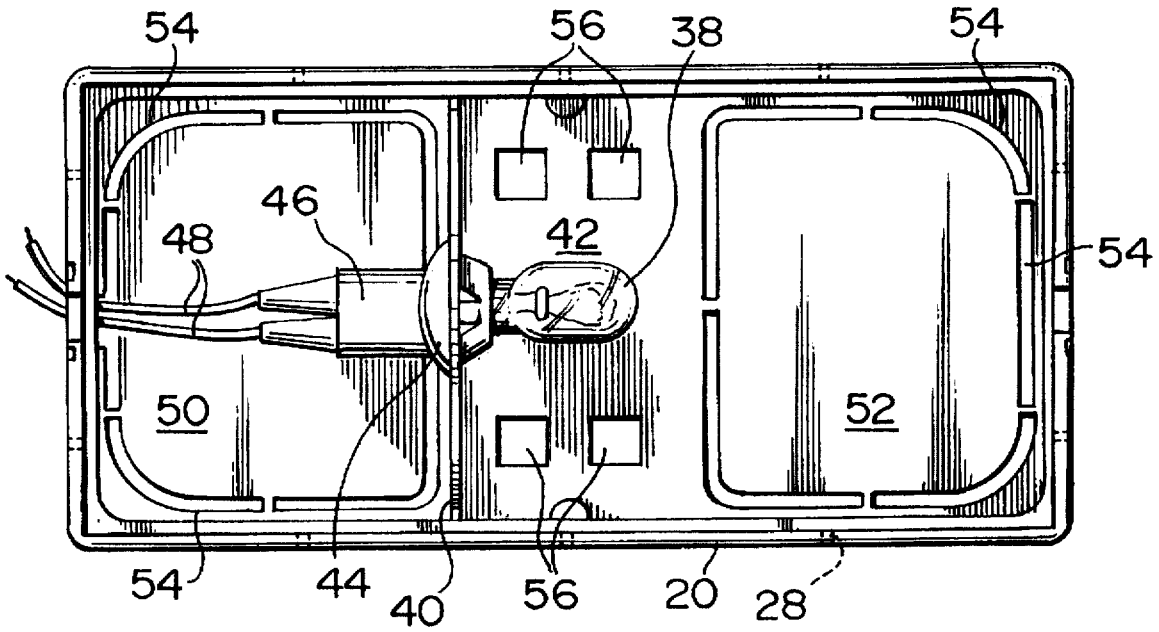
FIG. 8 is a plan view of the main body of the brick of FIG. 4.
Figure 9:
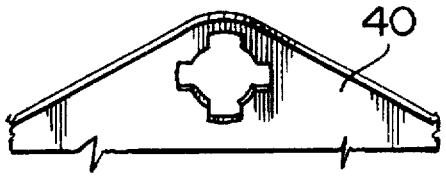
FIG. 9 is a perspective view of the bulb support member within the main body portion of the brick of FIG. 4.

In FIG. 8 a plan view of the main body portion 20 is shown. An electric light bulb 38 is supported on an upstanding bracket 40 which is molded integrally with the base 42. The shape of the bracket 40 is shown in FIG. 9 and is provided with an aperture 44 for mounting the light bulb socket 46. Wires 48 pass out of the brick to a suitable voltage supply system such as 18 in FIG. 1.

The base 42 is molded of thin material and, in practice, the whole of the main body portion 20 is molded as one piece, for example of polypropylene. In some areas of the United States, such as California, the brick may be resting on a sandy underlay which would not support a brick with a completely open base. Thus the base 42 of FIG. 8 is shown with fill-in/push-out portions 50 and 52 whilst still leaving a substantial part of the area of the base open to facilitate drainage and substantially reduce condensation. The push-out portions 50 and 52 are surrounded by openings 54 in the base which permit drainage through them when it is wished to retain portions 50 and 52, for example in California. In other parts, the portions 50 and 52 may be pushed out to provide an even greater area for drainage. Apertures 56 are also provided in the base for drainage purposes.

In some cases only one push-out portion, such as 50 or 52, may be provided. About 5% to 95% of the base area may be open to facilitate drainage and substantially reduce condensation.

Whilst the brick has been illustrated as of rectangular cross-section and cuboid in shape, it will be appreciated that it may be of any convenient shape. For example, bricks, such as stepping stones, may be of circular cross-section.

The top lens portion may be made of an acrylic-polycarbonate. LEXSAND is the trade name of one material used. In different climates, a different rate of expansion exists between the polycarbonate top lens portion and the main body portion. Thus special steps have to be taken to ensure a snug-fit for the top lens portion and the retaining tabs 32 assist in this regard if unexpected expansion takes place.

The brick may, for some purposes, be made of charcoal. Many illuminating brick colours are available, for example light brown, dark brown, red, charcoal and grey.

It will be readily apparent to a person skilled in the art that a number of variations and modifications can be made without departing from the true spirit of the invention which will now be pointed out in the appended claims.

I claim:

1. A brick device comprising in combination:

a hollow simulated brick portion having a main body portion molded in one piece with a pair of opposing longitudinal side portions, a pair of opposing end portions, a base portion, and an open top, an integrally molded electric bulb support bracket portion on said base portion intermediate said pair of end portions, at least one aperture provided in said base portion, said base portion having at least one push-out portion in another aperture to provide a support platform for the brick portion in use and capable of being removed to provide a larger aperture space in said base portion, the aperture space in said base portion being such that the brick portion is open over a part of an area of said base portion to facilitate drainage and substantially reduce condensation, a ledge around said open top of said brick portion, a light-emitting upper surface portion resting on said ledge to fit snugly and close said open top, at least one retaining tab on an edge of said light-emitting upper surface portion, and a corresponding aperture in said main body portion above said ledge for said one retaining tab to engage in when said light-emitting upper surface portion rests on said ledge.

2. A brick device according to claim 1 wherein said light-emitting upper surface portion is provided with a said retaining tab at each opposite end thereof, said opposing end portions of said main body portion being each provided with a corresponding aperture for a said retaining tab to engage in.

3. A brick device according to claim 1 wherein said light-emitting upper surface portion is provided with two spaced-apart retaining tabs, said opposing end portions being each provided with corresponding apertures for said retaining tabs to engage in.

4. A brick device according to claim 3 wherein a slot is provided between each two spaced-apart retaining tabs for insertion of an implement therebetween to facilitate removal of said light-emitting upper surface portion from said main body portion.

5. A brick device according to claim 1 wherein said base portion is provided with two push-out portions each occupying about one third the area of said base portion.

6. A brick device according to claim 1 wherein an aperture is provided in said bulb support bracket portion and including a light bulb socket secured in said aperture, an electric light bulb in said socket and electric supply wires connected at one end to said socket, the wires extending out through an aperture in said main body portion for connection to a power supply system.

7. A brick device according to claim 1 wherein said base portion of said main body portion is open over about 5% of the area of said base portion.

8. A brick device according to claim 1 wherein said base portion of said main body portion is open over about 95% of the area of said base portion.

9. A brick device according to claim 1 wherein the exterior surfaces of said opposing longitudinal side portions and opposing end portions are provided with strengthening rib members.

10. A brick device according to claim 1 wherein said main body portion is molded of polypropylene.

11. A brick device according to claim 1 wherein said light-emitting upper surface portion is clear.

12. A brick device according to claim 1 wherein said light-emitting upper surface portion is colored.

* * * * *